United States Patent [19]

Evans et al.

[11] Patent Number: 4,875,351

[45] Date of Patent: Oct. 24, 1989

[54] ELECTRONIC TIME LOCK

[75] Inventors: Walter R. Evans, Lancaster; Joseph M. Remenicky, Nicholasville; Thomas E. Jasper, Bryantsville; Wayne W. Ballard, Nicholasville, all of Ky.

[73] Assignee: Sargent & Greenleaf, Inc., Nicholasville, Ky.

[21] Appl. No.: 234,562

[22] Filed: Aug. 19, 1988

[51] Int. Cl.[4] ..... E05B 43/00

[52] U.S. Cl. ..... 70/271

[58] Field of Search ..... 70/267–274

[56] References Cited

U.S. PATENT DOCUMENTS

| | | | |
|---|---|---|---|
| 213,809 | 4/1879 | Chinnock | 70/271 |
| 428,852 | 5/1890 | Myers | 70/273 |
| 3,835,679 | 9/1974 | Heinemann et al. | 70/432 X |
| 3,950,678 | 4/1976 | Brewer | 70/271 X |
| 4,062,210 | 12/1977 | Uyeda | 70/268 |
| 4,137,738 | 2/1979 | Marold | 70/274 |
| 4,655,061 | 4/1987 | Nishikawa et al. | 70/271 |

FOREIGN PATENT DOCUMENTS

| | | | |
|---|---|---|---|
| 2142374 | 1/1985 | United Kingdom | 70/271 |

*Primary Examiner*—Lloyd A. Gall

*Attorney, Agent, or Firm*—Mason, Fenwick & Lawrence

[57] ABSTRACT

An electronic time lock for bank vault doors and the like having a door bolting mechanism including a snubber bar, the time lock including a lock case, an intermediate vertical partition located in said chamber between front and rear walls of the case, the rear wall and intermediate partition having surfaces defining cylindrical guide bores for reciprocating movement of the snubber bar therein. A pair of electric motors are arranged in side-by-side relation on the intermediate partition to drive a blocking member through a pair of drive trains between blocking and release position for blocking the snubber bar against movement to an unlocking position and releasing the snubber bar. A printed circuit board is provided having a solid state visible display strip for displaying programmed instructions and information regarding the state of the time lock aligned with a window in the front wall of the case for viewing of the displayed information therethrough and a plurality of electrical switch program buttons are located on the front wall of the lock case.

16 Claims, 4 Drawing Sheets

ELECTRONIC TIME LOCK

BACKGROUND AND OBJECTS OF THE INVENTION

The present invention relates in general to time locks for bank vault doors, safe doors, and similar security closures, and more particularly to electronic time locks having a micro-processor controlled display and program selector buttons and circuitry for activating drive motor means, providing a plurality of selective timing and security features governing operation of the time lock.

Heretofore, many types of mechanical time lock mechanisms have been provided for controlling opening and locking of bank vault doors, safe doors and the like, wherein the time lock has a movable bolt within the lock housing presenting a barrier blocking movement of snubber bar for the vault or safe door locking mechanism from its normal vault locking position and movable to an unlocking position permitting such movement of the snubber bar as will enable unlocking of the vault door locking apparatus. These have customarily involved one or a plurality of timer mechanisms which can be set to various time delay conditions, for example such as will prevent operation of the time lock to open the safe or vault door following locking thereof at the close of business day until a time lapse of 16 hours, or a time lapse of several days where a weekend intervenes. Time delay setting of the time lock mechanism for other situations, such as for short term lock out periods or other security restriction situations and the like require meticulous resetting of the timer units and introduce the possibility of incorrect setting or malfunction of the lock. Also such lock are dependent upon the accuracy and long term operational reliability of the clock work components of the timer units and are undesirably restrictive in the number of time related control functions which may be programmed into the lock.

An object of the present invention is the provision of a novel mechanical structural assembly for an electronic time lock having a visible display and a plurality of programming or function keys, interconnected with a microprocessor and control circuitry, including motor means for shifting a bolt mechanism between blocking and release positions relative to a snubber bar of a vault door locking system, together with drive motor means and associated motor driven drive train means, and manual override facilities, eliminating many disadvantages and restrictions of clock work timer unit controlled time locks.

Another object of the present invention is the provision of an electronic time lock structural mechanism which is reliable in operation over a long period of use and provides a backup drive motor mechanism to ensure operation of the bolt if malfunction occurs in the primary motor drive system, and which provides a wide variety of selectable programmed conditions for various security and time control operating conditions.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
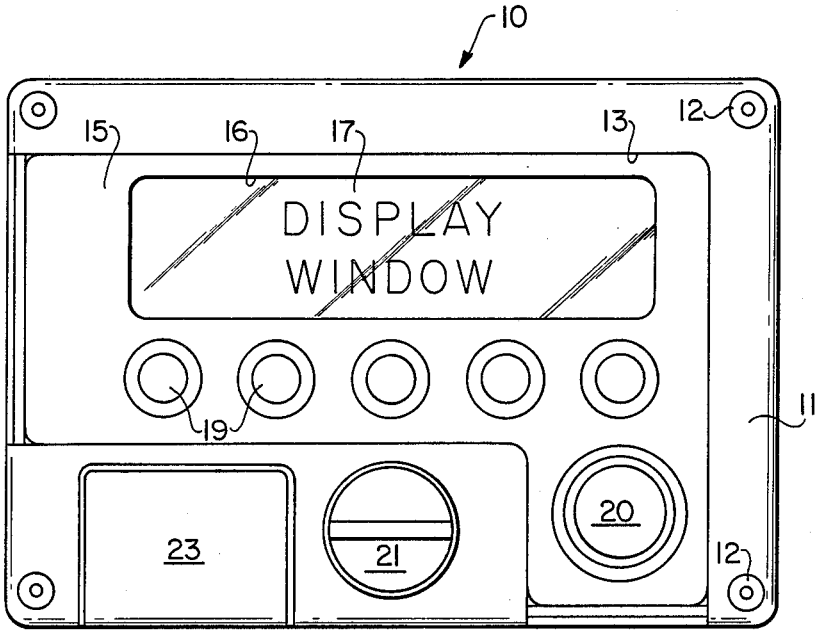
FIG. 1 is a front elevational view of an electronic time lock embodying the present invention.

Referring to the drawings, wherein like reference characters designated corresponding parts throughout the several figures, the electronic time lock with the present invention is indicated generally by the reference character 10, and comprises a generally box shaped rectangular body having a front cover 11 secured by mounting screws 12 at the corners thereof to a molded rectangular forwardly opening box shaped case 13. Viewed from the front, as seen in FIG. 1, the front cover includes a shallow recess or well 14 to receive a front plate in the form of a keyboard 15 of distorted L-shaped configuration. The keyboard 15 and the front wall of the front cover member 14 have registering windows **16*a* and 16*b* defining a window 16 for viewing the time lock display, indicated 17, which in the illustrated embodiment is a liquid crystal display unit. The display unit 17 is mounted on the printed circuit board 18 fixed on the case 13 immediately behind the front wall portion 11*a* of the cover 11. The keyboard 15 also contains a transverse row of programming keys, indicated at 19, in the form of program selector buttons formed, for example, of pressure sensitive switches of known design, five of which are arranged below the display 17 of the time lock. Also, a larger circular HELP key 20 is provided in the lower right hand corner portion of the keyboard 15 and a circular knob 21 keyed onto the front end of an over-ride shaft 22 is provided in the lower center portion of the front wall 11*a* of the cover 11. A removable port cover 23 is also provided, shown near the lower left hand corner portion of the front cover 11, which covers a plug, indicated at 23*a***, for connection to a plural conductor lead to a remote display or printer, or the like.

Figure 2:
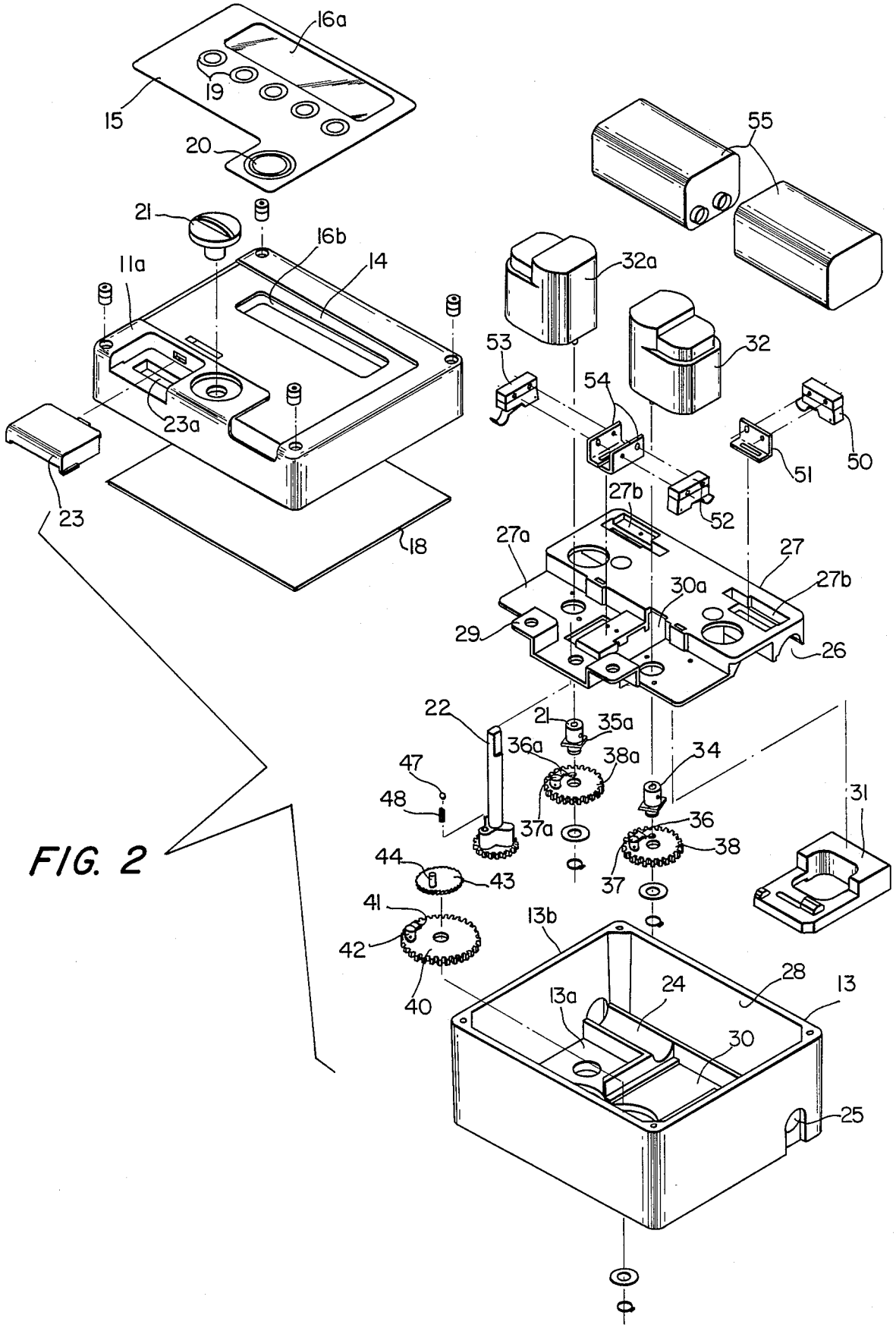
FIG. 2 is an exploded perspective view thereof.
Figure 3:
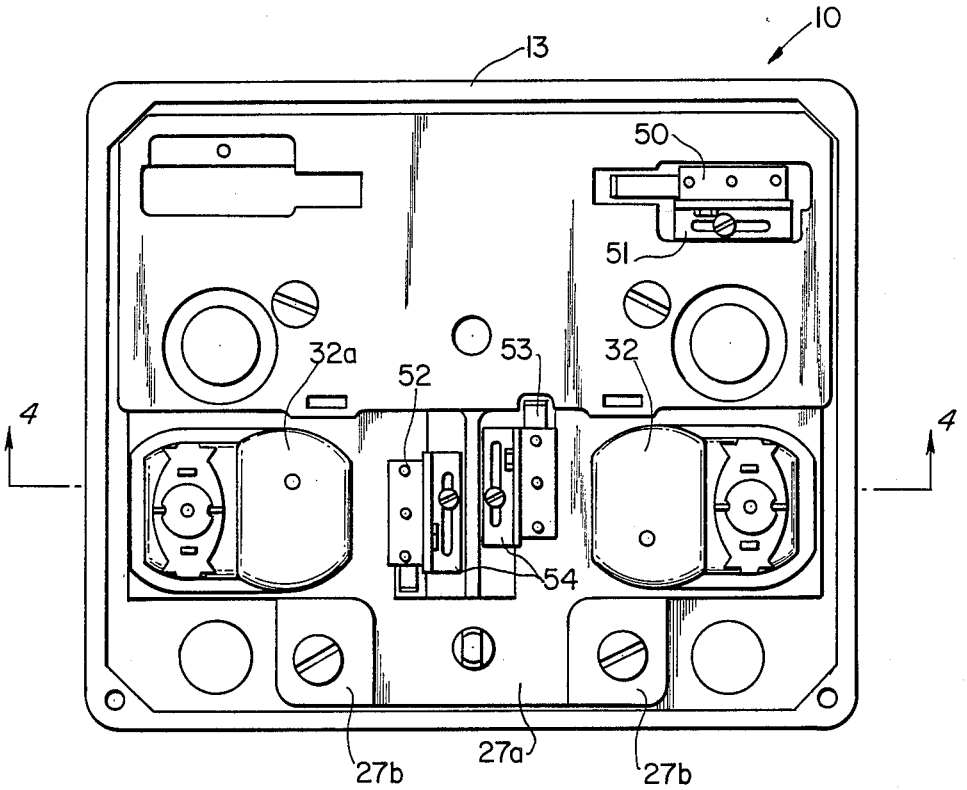
FIG. 3 is a front elevational view with the front cover and PC board components removed.
Figure 4:
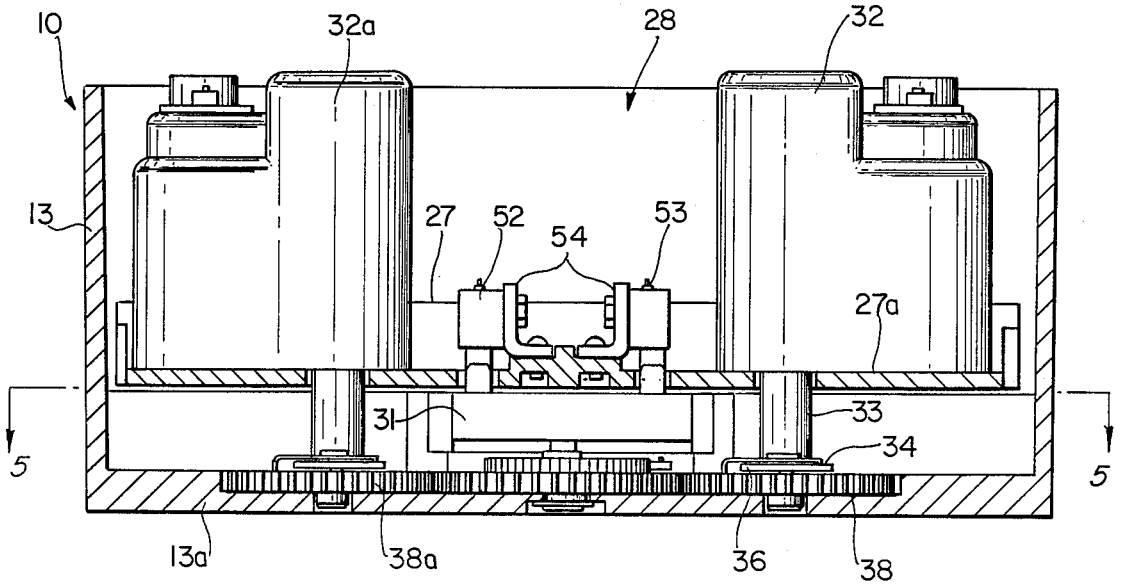
FIG. 4 is a vertical transverse section view thereof taken along the line 4—4 of FIG. 3.
Figure 6:
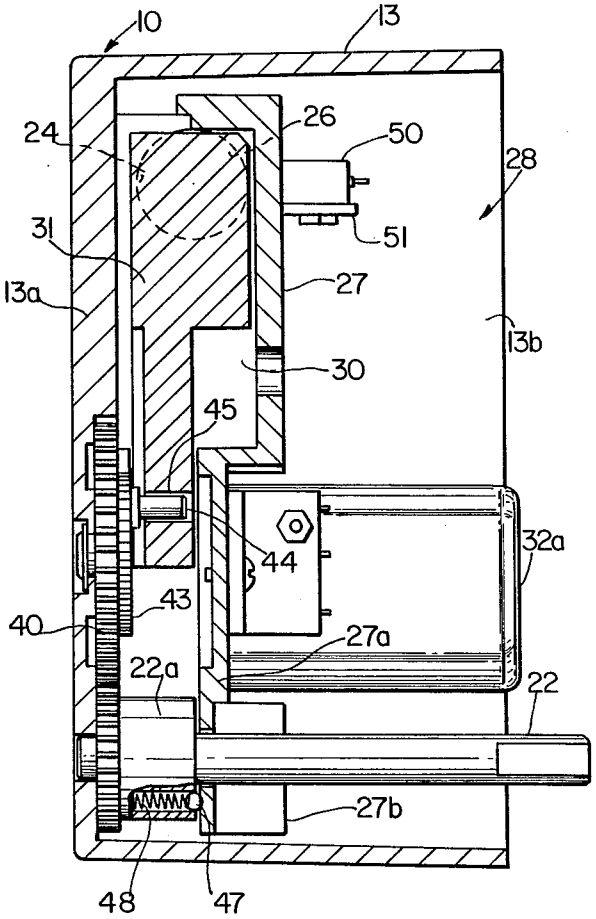
FIG. 6 is a vertical fore-and-aft section view, taken along line 6—6 of FIG. 5.
Figure 5:
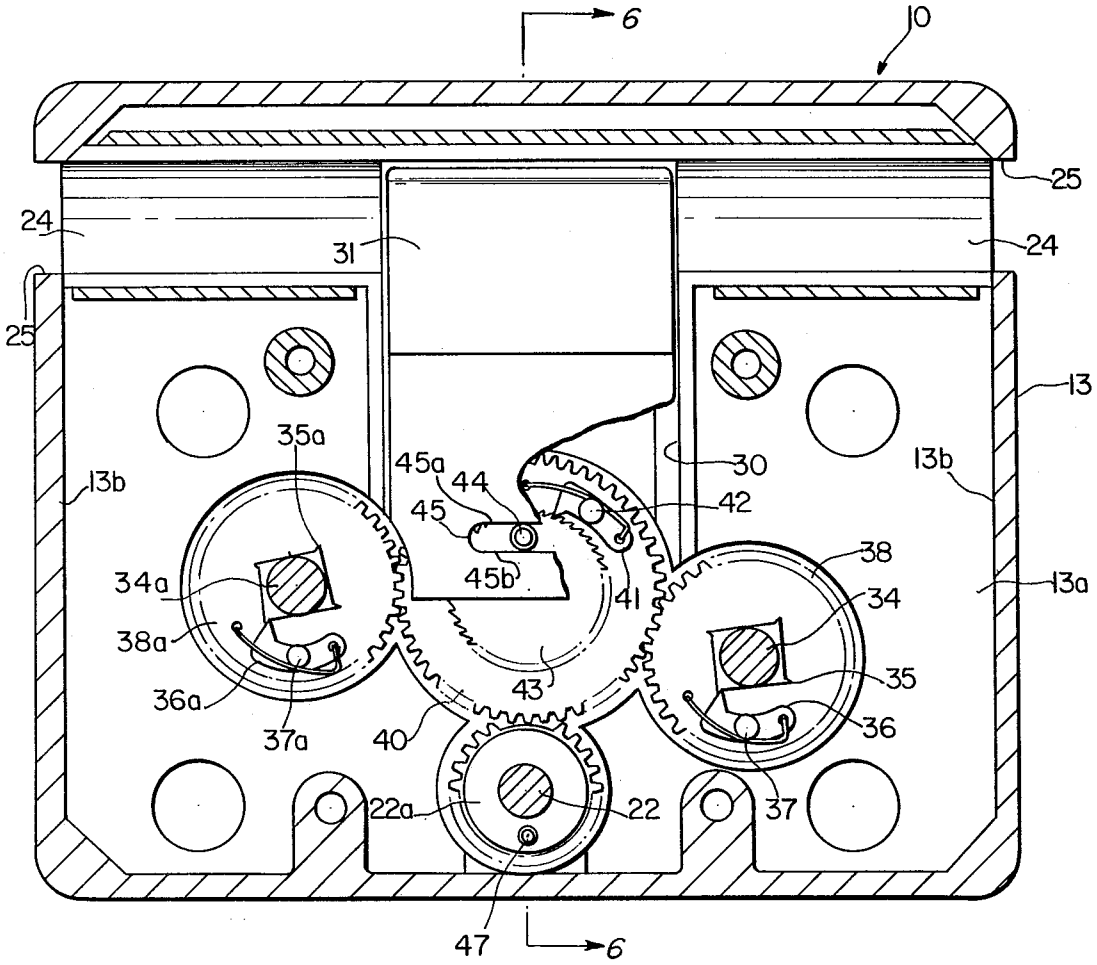
FIG. 5 is a vertical transverse section view showing the drive gear trains and part of the bolt, taken along line 5—5 of FIG. 4.

The rear wall **13*a* of the case 13 is shaped to provide semi-cylindrical forwardly facing half cylindrical bore formations 24 communicating with circular openings 25 in the sidewalls 13*b* of the case 13 through which the snubber bar of the vault door locking apparatus is received. The remainder of the bore for the snubber bar is formed by confronting rearwardly facing half cylindrical bore formations 26 facing rearwardly from the upper portion of a base plate 27 which forms an intermediate vertical partition within the mechanism chamber 28 of the case. The lower portion of the base plate 27 is secured by mounting shoulder formations 27*a* against mounting surfaces on the rear wall of the lock case 13, being held by suitable mounting screws or bolts. The rear wall of the case 13 and confronting portion of the base plate 27 are also provided with a bolt receiving recess, shown for example at 30 in FIGS. 2, 5 and 6, slidably receiving the bolt 31 therein for vertical sliding movement from an uppermost locking position wherein the enlarged upper portion of the bolt 31 blocks the snubber bar bore formed by the semi cylindrical bore portions 24, 26, to a lower unlocking position. In the lower unlocking position the uppermost surface of the bolt 31 terminates immediately below the snubber bar bore defined by surfaces 24, 26, permitting passage of the snubber bar through the space vacated by the bolt 31**, (which was blocked by the bolt when in locking position), for opening of the vault door locking apparatus.

The bolt 31 is normally driven between its raised blocking position and its lower unlocking position by a primary drive motor 32 mounted on the lower rearwardly offset portion 27*a* of the base plate 27, having its output shaft 33 connected to drive gear hub 34. The drive gear hub 34 has ratchet teeth 35 on an enlarged portion thereof, coactive with a drive gear pawl 36 pivoted on a pawl rivet 37 carried eccentrically on the drive gear 38, to rotate the drive gear 38 about its axis responsive to rotation of the output shaft of primary motor 32. The teeth of the drive gear 39 interfit with teeth of the center gear 40 journalled for rotation on the back wall of the case 13, having a center pawl 41 pivoted at an eccentric location on a pawl rivet or pivot pin 42, and having a pawl tooth engaging ratchet teeth on the center gear hub member 43 carrying an eccentric drive pin 44 which interfits in the slot 45 of the bolt 31. The upper and lower surfaces 45*a*, 45*b* of the slot 45 in the bolt or blocking member 31 provide shoulder formations engaged by the drive pin 44 on the center gear hub member 43 to move the blocking member or bolt 31 upwardly and downwardly between blocking and unblocking positions, upon rotation of the hub member 43 and center gear 40.

A similar redundant motor drive mechanism forming a backup or secondary motor drive train is also provided, in case of malfunctioning of the primary motor drive train. This comprises the motor 32*a* similar to the 32, whose output shaft engages drive gear hub 34*a* having ratchet teeth 35*a* coacting with drive gear pawl 36*a* on the drive gear 38*a* whose peripheral teeth also interfit with the teeth of the center gear 40. The sole purpose of the secondary motor 32*a* is to provide backup operation of the lock to open it, in case of failure of the primary motor occurrence of low battery power, or the like. The microprocessor on the printed circuit board 18 includes means for sensing the operation of the secondary or backup motor 32*a* and displaying a system error indication on the liquid crystal display 17. Manual override is also provided by the shaft 22 and override knob 21, the override shaft 22 having an actuator formation 22*a* on the rearmost end thereof engaging a coactive shoulder formation on the bolt 31 to retract the bolt to the lowered position permitting opening of the vault door mechanism upon manual activation of the override knob. A detent ball 47 and spring 48 coacts with a detent recess in the actuator finger formation 22*a* of the override shaft assembly releasably restraining it in the normal inactive position.

The lock is also provided with a microswitch 50 supported on a mounting bracket 51 with the microswitch movable arm and a portion of the microswitch body extending through either of the openings 27*b* near the top of the base plate 27 communicating with the snubber bar receiving bore formed by coactive surfaces 24, 26, to sense the entry of the snubber bar from the vault door apparatus. Vertical positions sensing microswitches 52 and 53 are also mounted on switch mounting brackets 54 with their feelers or movable contact arms disposed to sense the position of the locking bolt 31. These three microswitches are connected through a wiring harness to the printed circuit board 18. A battery holder 55 is also provided to removably support two six volt DC batteries, with terminal connection to the printed circuit board, for microprocessor and control circuitry connection to the primary drive motor 32 and secondary or backup drive motor 32*a* and providing appropriate interconnection with the HELP key 20, the program selector keys or buttons 19 and the liquid crystal display 17.

The construction and arrangement of the drive train provides a deadbolt feature preventing the bolt 31 from being ratcheted down. When the primary motor 32 is energized and the gear 38 rotates, this causes the center gear 40 to rotate clockwise. As the center gear 40 rotates clockwise, it causes the bolt 31 to move up and down due to the action of the drive in 44 on the shoulder formations formed by the bounding surface 45*a*, 46 *b* of the slot 45 of the bolt 31. The position of the bolt 31 stopping in the up or down position is sensed by the microswitches 52 and 53 respectively. The up position is most critical, as the microswitch 52 must be so adjusted as to sense the bolt 31 in its upward travel to properly achieve the deadlocking feature:. To properly ensure this deadlocking action, the microswitch 52 should be adjusted in such a way that the drive pin 44 will stop at its eleven o'clock position (assuming that the twelve o'clock position is when the bolt is in its fully up and closed position). If the microswitch 52 is improperly adjusted so that the bolt is at, for example, the action, there will be no deadlocking and the bolt could be ratcheted down.

The microswitch 50 serves an important snubber sensing purpose. This microswitch can be mounted for right or left snubber bar sensing. If the snubber bar is detected in the portion of the bore 24 with which the microswitch 50 is associated, the bolt 31 is prevented from being raised to the up or closed position. If the snubber bar has been occupying its bore in the lock, and is then intermittently retracted but quickly forced back in, the bolt if it had a positive gear drive train from the energized motor would continue its upward travel and become jammed into the snubber bar. However, because of the ratcheting action provided by the ratchets 36 and 41 in the drive train, the bolt cannot be jammed into the snubber bar. If the snubber bar sensing microswitch 50 is adjusted properly, such undesired jamming of the bolt into the snubber bar is avoided.

The microprocessor may be programmed in many different ways and does not constitute a part of the present invention.

Some typical programming options which may be provided by the microprocessor and which may be enabled by executing predetermined programming commands with the buttons or keys 19 are:

REAL TIME (RT)

Allows setting of actual day and time. Protected by security codes. Maintained during battery changes.

Example: The owner has just received his new electronic time lock and installed the batteries. It is now 1:05 p.m. Tuesday. Enter Tuesday, 13:05.

WEEKLY PROGRAM (Wkl)

Basis for time lock function. Up to 4 independent openings and closings per day. Each day is independent. A daily program can be copied to one or more other days. Program repeats indefinitely unless overridden.

SHORT CLOSE (SC)

Overrides open time in weekly program. It is simple and immediate. Up to 99 minutes in 1 minute increments.

EXTRA CLOSE (EC)

Overrides open time in weekly program. Set day and time of the next opening. Will not override closed time. Maximum of one week.

Example: The owner's business establishment is normally open 5 days each week. It is Wednesday and the establishment will be closed Thursday and Friday for a holiday. Enter EC and program for Monday at 8:00.

VACATION (VAC)

Overrides weekly program open times during the vacation period. Programmable up to 1 week in advance. Up to 36 day period. Protected by security codes.

Example: Business is closed from December 24 to January 2 for the holidays. On December 21, program 10 days of vacation to begin at 01:00 on December 24.

SUMMERTIME /WINTERTIME (ST) or (WT)

Adjusts for daylight savings time. Programmable up to 1 week in advance. Takes effect at 02:00 on Sunday. Cannot be reset for one week.

Example: It is Fall this Sunday locks will be set back one hour due to daylight savings time. You select WT from the menu and confirm. The real time will automatically change at 02:00 Sunday to 01:00.

TIME DELAY (TD)

Time delay up to 99 minutes. Opening window up to 10 minutes. Externally triggered. Protected by codes.

Example: For security, owner may like a 15 minute delay between opening the primary lock and having the vault openable. Enter TD with a delay of 15 minutes and a window of 5 minutes.

We claim:

1. An electronic time lock for bank vault doors and the like having a door bolting mechanism including a snubber bar, the time lock comprising a lock case in the form of a generally rectangular box having parallel vertical front and rear walls; in a use position and enclosing side, top and bottom walls defining a mechanism chamber, an intermediate vertical partition located in said chamber between said front and rear walls, said rear wall and intermediate partition having means defining cylindrical guide bores for reciprocating movement of the snubber bar therein and said side walls having holes aligned therewith for receiving the snubber bar therethrough, a pair of electric motors arranged in side-by-side relation carried by said intermediate partition, a blocking member in said case movable between blocking and release positions relative to said guide bores for blocking the snubber bar against movement to an unlocking position for the door bolting mechanism and releasing the snubber bar for movement to an unlocking position, main gear means having a drive formation driven thereby coactive with shoulder formations on said blocking member for moving the blocking member between said blocking and release positions responsive to rotation of the main gear means, a pair of drive trains coupled to and driven by the respective drive motors for driving the main gear means from either of said drive motors to shift the blocking member between said blocking and release positions, a printed circuit board having a solid state visible display strip thereon for displaying programmed instructions and information regarding the state of the time lock, the front wall of said lock case having a window therein aligned with said display strip for viewing of the displayed information therethrough, a plurality of electrical switch program buttons carried by said front wall of said lock case, a plurality of position sensors sensing the position of said blocking member and for sensing the position of the snubber bar in said guide bores, and electronic circuitry on said printed circuit board including microprocessor means interconnected with said program buttons and said electric motors and sensor means for activating the electric motors in accordance with predetermined time lock programs.

2. An electronic time lock as defined in claim 1, including a manual override means having a manually operable member exposed at said front wall of said lock case and having means for manually driving said main gear means for manual movement of the blocking member from blocking to release position under selected predetermined conditions.

3. An electronic time lock as defined in claim 1, wherein said rear wall and said intermediate partition having confronting recess formations mating to collectively define a vertical guide channel intercepting and communicating with said guide bores to guide the blocking member movement between a raised location and a lower location respectively defining said blocking and release positions.

4. An electronic time lock as defined in claim 2, wherein said rear wall and said intermediate partition having confronting recess formations mating to collectively define a vertical guide channel intercepting and communicating with said guide bores to guide the blocking member movement between a raised location and a lower location respectively defining said blocking and release positions.

5. An electronic time lock as defined in claim 1, wherein said position sensors are formed by microswitches providing an arm protruding into one of said guide bores and a pair of upper and lower arms protruding into intercepting engagement with said blocking member at the blocking and release positions of the latter.

6. An electronic time lock as defined in claim 2, wherein said position sensors are formed by microswitches providing an arm protruding into one of said guide bores and a pair of upper and lower arms protruding into intercepting engagement with said blocking member at the blocking and release position of the latter.

7. An electronic time lock as defined in claim 3, wherein said position sensors are formed by microswitches providing an arm protruding into one of said guide bores and a pair of upper and lower arms protruding into said vertical guide channel at two vertically spaced locations to extend selectively into intercepting engagement with said blocking member at the raised and lowered positions of the latter.

8. An electronic time lock as defined in claim 4, wherein said position sensors are formed by microswitches providing an arm protruding into one of said guide bores and a pair of upper and lower arms protruding into said vertical guide channel at two vertically spaced locations to extend selectively into intercepting engagement with said blocking member at the raised and lowered positions of the latter.

9. An electronic time lock as defined in claim 1, wherein each said drive train comprises an output shaft of an associated one of said motors having a hub member with ratchet teeth thereon, a rotatable drive gear member having peripheral driving engagement with said main gear means and having a pawl pivoted on said gear member engageable by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

10. An electronic time lock as defined in claim 2, wherein each said drive train comprises an output shaft of an associated one of said motors having a hub member with ratchet teeth thereon, a rotatable drive gear member having peripheral driving engagement with said main gear means and having a pawl pivoted on said gear member engageable by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

11. An electronic time lock as defined in claim 3, wherein each said drive train comprises an output shaft of an associated one of said motors having a hub member with ratchet teeth thereon, a rotatable drive gear member having peripheral driving engagement with said main gear means and having a pawl pivoted on said gear member engageable by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

12. An electronic time lock as defined in claim 4, wherein each said drive train comprises an output shaft of an associated one of said motors having a hub member with ratchet teeth thereon, a rotatable drive gear member having peripheral driving engagement with said main gear means and having a pawl pivoted on said gear member engagable by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

13. An electronic time lock as defined in claim 5, wherein each said drive train comprises an output shaft of an associated one of said motors having a hub member with ratchet teeth thereon, a rotatable drive gear member having peripheral driving engagement with said main gear means and having a pawl pivoted on said gear member engageable by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

14. An electronic time lock as defined in claim 6, wherein each said drive train comprises an output shaft of an associated one of said motors having a hub member with ratchet teeth thereon, a rotatable drive gear member having peripheral driving engagement with said main gear means and having a pawl pivoted on said gear member engageble by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

15. An electronic time lock as defined in claim 7, wherein each said drive train comprises an output shaft of an associated one of said motors having a hub member with ratchet teeth thereon, a rotatable drive gear member having peripheral driving engagement with said main gear means and having a pawl pivoted on said gear member engageable by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

16. An electronic time lock as defined in claim 8, wherein each said drive train comprises an output shaft of an associated one of said motors having a hub member with ratchet teeth thereon, a rotatable drive gear member having peripheral driving engagement with said main gear means and having a pawl pivoted on said gear member engageably by said ratchet teeth, and said main gear means including a rotatable main gear member having peripheral teeth engaging the teeth of said drive gear member and a pawl pivoted thereon and a ratchet wheel coaxial with said main gear member having ratchet teeth engaged and driven by said last-mentioned pawl and having an eccentric drive pin extending into a slot in said blocking member to move the latter to said blocking and release position.

* * * * *